United States Patent [19]

McKibben

[11] 3,943,668

[45] Mar. 16, 1976

[54] VIBRATORY MILL STRUCTURE

[75] Inventor: Richard K. McKibben, La Canada, Calif.

[73] Assignee: Sweco, Inc., Los Angeles, Calif.

[22] Filed: Apr. 30, 1975

[21] Appl. No.: 573,383

Related U.S. Application Data

[63] Continuation of Ser. No. 357,447, May 4, 1973, abandoned.

[52] U.S. Cl. ..... 51/163 V; 198/220 BC

[51] Int. Cl.[2] ..... B24B 31/06

[58] Field of Search ..... 51/7, 163; 241/175; 198/220 BC

[56] References Cited

UNITED STATES PATENTS

| | | | |
|---|---|---|---|
| 2,934,202 | 4/1960 | Roder | 51/163 |
| 3,258,111 | 6/1966 | Spurlin | 198/220 BC |
| 3,422,577 | 1/1969 | McKibben | 51/163 |
| 3,553,900 | 1/1971 | McKibben | 51/163 |

FOREIGN PATENTS OR APPLICATIONS

| | | | |
|---|---|---|---|
| 4,529,358 | 9/1966 | Japan | 51/163 |
| 271,328 | 1970 | U.S.S.R. | 51/163 |
| 348,367 | 2/1922 | Germany | 198/220 BC |

*Primary Examiner*—Harold D. Whitehead
*Attorney, Agent, or Firm*—Lyon & Lyon

[57] ABSTRACT

A vibratory mill having a long, thin milling chamber which spirals upward in a conical arrangement from a center location within a housing to a point at the periphery of the housing. The configuration of the chamber improves the efficiency of the mill and promotes the use of a continuous operation rather than a batch process. Eccentrically mounted rotating weights cause the media and parts to migrate upward from a central receiving position to the periphery of the housing.

2 Claims, 2 Drawing Figures

VIBRATORY MILL STRUCTURE

This is a continuation of application Ser. No. 357,447, filed May 4, 1973 and now abandoned.

The present invention is directed to the design and construction of vibratory mills used for grinding, polishing, deburring and the like. More specifically, this invention is directed to a long, thin vibratory mill chamber arranged in a conical path.

Vibratory mills have been developed which employ simple helical finishing chambers. One such device employing a simple helical chamber is disclosed in McKibben, U.S. Pat. No. 3,422,577. It has been determined that such helical arrangements lend themselves to continuous processes in comparatively light operations. The vibrations developed tend to move the media and parts upward along the helix and out of the mill housing which thereby permits the introduction of new unfinished parts at the lowest point of the helical path. However, such cavities do not normally exceed 360° of rotation about the mill housing. Consequently, parts which require long finishing time must be reintroduced into the mill for further processing. As a result, the mill must be used for batch process rather than continuous operation. Further, such mills do not optimize the use of space within any given mill housing.

The present invention provides a long, narrow mill chamber compactly placed within a cylindrical vibratory mill housing. The chamber is placed within the housing to form a path which spirals upward from a central position to the periphery of the housing in a conical arrangement. The reduced width and increased length of the chamber create maximum intimate contact of the body of media with the unfinished parts. Further, the long path allows complete finishing of even hard to finish parts in a single cycle of the mill. A maximum use of the available space within the housing is also achieved.

Accordingly, an object of the present invention is to provide a mill having a long, narrow chamber located therein.

Another object of the present invention is to provide a long, narrow chamber formed in a conical path within a housing.

Another object of the present invention is to provide a mill chamber particularly adapted to be employed with continuous feeding systems.

Thus, an improved mill structure is disclosed. A long, narrow chamber is disclosed which lends itself to continuous and efficient operation. Other objects and advantages of the present invention will be made readily apparent from the following detailed description and accompanying drawings.

Figure 1:
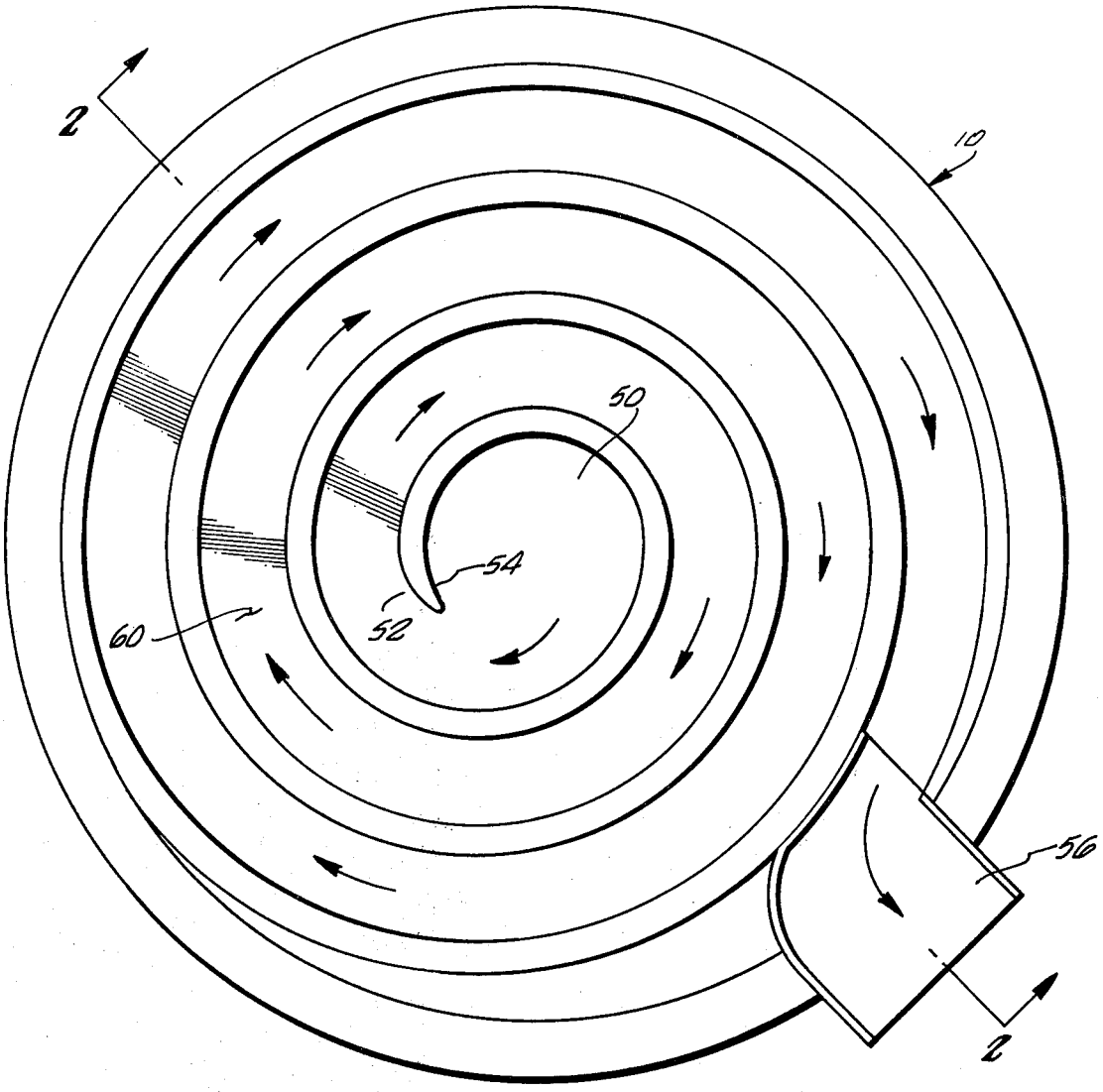
FIG. 1 is a plan view of the conical mill.

Turning specifically to the drawings, a mill is disclosed which includes a cylindrical housing generally designated 10. The housing 10 includes an annular rim 12 for added structural rigidity and easy handling. A cylindrical wall 14 and a circular base plate 16 form the main portion of the housing. The base plate 16 is welded to the wall 14 to form a leak proof cylindrical enclosure. A circular channel support member 18 is welded on to the base plate 16 for further structural support and as a means for mounting the housing 10 to the mill base 20.

The mill base 20 is a cylindrical support structure having an annular base ring 22 located at ground level and an annular flange 24 located at the upper edge of the cylindrical base 20. Webs 26 are radially disposed about the cylindrical housng 20 and extend vertically between the annular ring 22 and the flange 24. Coil springs 26 are mounted about the periphery of the housing 20 to the flange 24. These springs extend upward to meet an annular mounting plate 30 where they are rigidly fixed. The annular plate 30 is also fixed to the circular channels 18. A resilient mounting of the mill is thereby provided.

The resiliently mounted mill further includes a cylindrical drive housing 32 which has a motor 34 positioned therein. The motor 34 is rigidly mounted to the drive housing 32 on annular brackets 36. Fasteners 38 allow removal of the motor 34 from the housing 32 for service and replacement. Eccentrics 40 and 42 are mounted to the drive of the motor 34 to create the desired vibrations. The drive housing is welded within the annular plate 30 to rigidly fix the housing 32 to the mill housing 10. Structural webs 44 provide added support about the periphery of the drive housing 32. To gain access to the motor 34, the annular plate 30 is preferably bolted or otherwise fastened to the circular channel member 18 in order that the mill housing may be lifted from the base 20 thus exposing the motor 34. Further, the fasteners 38 may be welded to the underside of brackets 36. The fasteners 38 then may extend upward to engage the motor 34. The motor may then be tied to the drive housing 32 from above.

Rigid foamed plastic material 46 is placed in situ within the mill housing 10. This foamed plastic material provides a support base 46 for the chamber. The support base 46 must be sufficiently rigid to allow transmission of the vibratory forces induced by the rotating eccentrics 40 and 42 from the housing 10 to the finishing chamber. One preferred material which may be employed for the support base 46 is polyurethane foam because it is comparatively inexpensive and light in weight. It can also be made in a variety of densities.

The finishing mill chamber is defined by a liner generally designated 48. The liner 48 is of a wear resistant plastic material such as cast polyurethane. The liner thickness primarily depends upon practical considerations such as the tooling available at the time of manufacture, the intended life of the lining, and the material costs. The lining 48 is one continuous cast piece extending across the width of the housing 10. Support is derived for the lining 48 from the support base 46 thus creating a rigid structure highly resistant to wear. Methods for making complex vibratory mill chambers are disclosed in a co-pending application filed concurrently herewith by Howard W. Wright, Jr., entitled VIBRATORY MILL STRUCTURE AND METHOD OF FORMING SAME, the disclosure of which is incorporated herewith.

Figure 2:
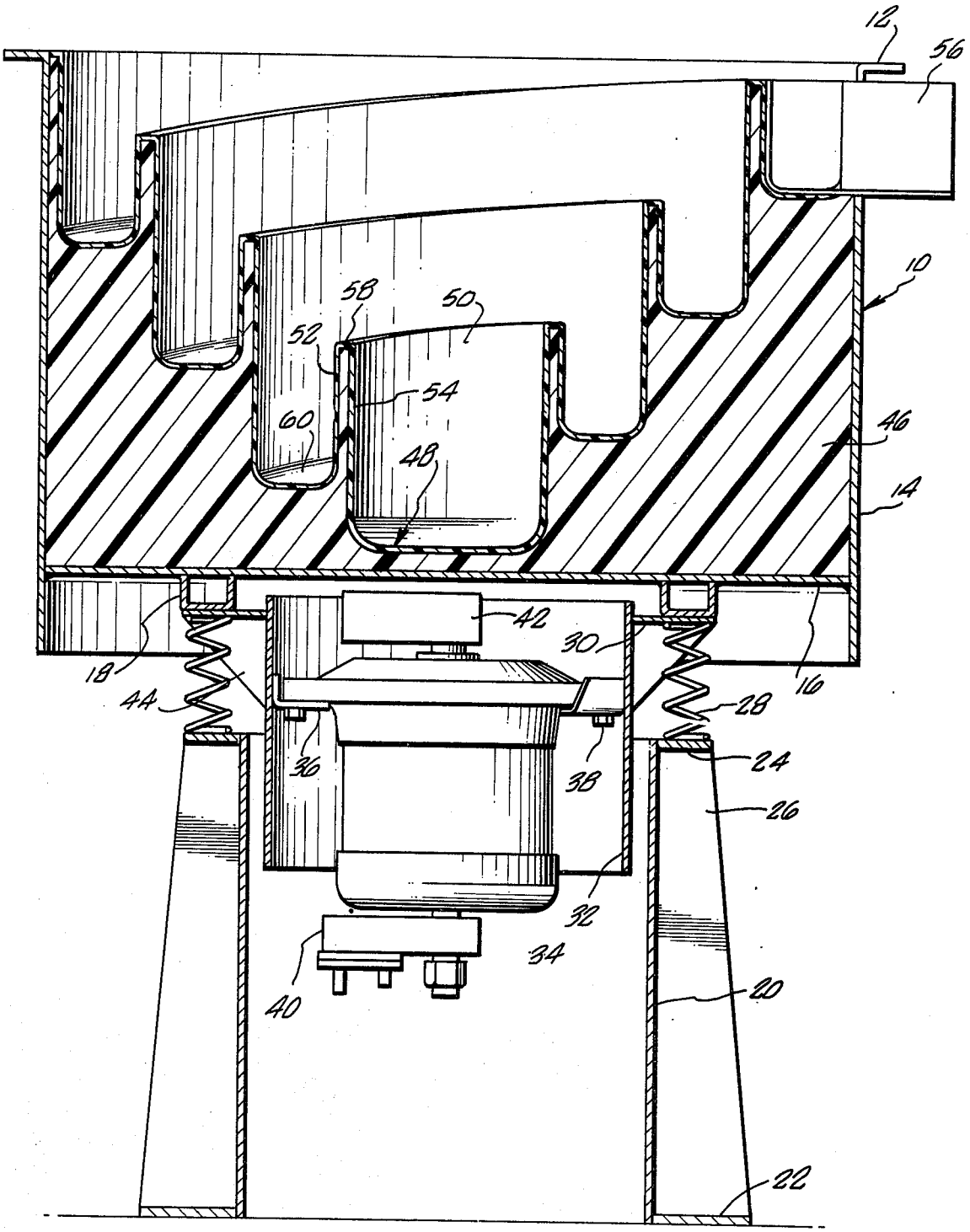
FIG. 2 is a cross-sectional view taken along line 2—2 of FIG. 1 illustrating the conical mill chamber.

The lining 48 defines a central receiving chamber 50 located at the lower most point of the mill chamber. Two continuous sidewalls 52 and 54 originate at the entrance to the central receiving chamber 50 and spiral upward to an outlet 56. Sidewall 54 initially extends about the central receiving chamber 50. The sidewalls 52 and 54 are joined between portions of the cavity by a cap section 58. A floor 60, also originating at the central receiving chamber 50 spirals upward between sidewalls 52 and 54. The spiraling sidewalls 52 and 54 and the floor 60 cooperate to form a long, narrow mill chamber which is arranged in a conical path as best seen in FIG. 2. Thus, a continuous path is provided between the central receiving chamber and the outlet 56.

Unfinished parts and media are positioned within the central receiving chamber 50 with the eccentrics 40 and 42 being driven by the motor 34. The eccentrics can be positioned so that the vibrations which result will cause the parts and finishing media to migrate from the central receiving chamber 50 upward along the spiraling floor 60 to exhaust at outlet 56. As the parts and media ascend the long mill chamber, the relative motion set up by the vibratory action of the mill between the parts and media operates to finish the surface of the parts. The long, narrow finishing mill chamber created by the present invention operates to effect maximum intimate contact between the total mass of media and the parts being processed. Consequently, the structure is advantageously suited for operations employing media which is not completely homogeneous. Further, it is believed that the narrow channel imparts maximum force and motion to each particle more frequently than in the larger chambers because of the width of the chamber. As another advantage, the entire cross-section of the housing is occupied by the finishing cavity thereby maximizing the volume available for finishing within any given housing 10. The present conical configuration further operates to extend the length of the chamber. By presenting a substantial chamber length, the versatility of the mill is greatly increased. The added length insures that all processing desired may be accomplished on the parts introduced at the central receiving chamber 50 before they reach the outlet 56. The eccentrics 40 and 42 may be positioned relative to one another to allow a range of migration speeds of the media and parts. Consequently, the control over migration rates and the length of the chamber insure that the mill can be set up for the finishing of the parts in a single cycle of the unit. Consequently, media and unfinished parts may be continually charged to the central receiving chamber 50 at a rate equal to the exhaust rate of parts and media from the outlet 56 without requiring the reintroduction of once cycled parts. When parts must be recycled through the finishing mill, the mill becomes a batch process mill.

To achieve a proper chamber ratio of length to width for a specific mill operation, the type of operation, the size of the included parts, the length of time needed to finish the operation and the size of the mill are to be considered. No specific configuration is required; rather, certain sizes and configurations lend themselves more readily to one operation than another. Where large parts are to be finished, a larger chamber width must be employed. Where the intended operation requires a substantial period of time to complete, a long chamber would be advantageous. It is suggested that advantageous chamber size for a mill having a 30 inch housing for finishing relatively small parts having substantial finishing requirements would include approximately a 6 inch diameter central receiving chamber and a 3 inch wide channel extending some 2½ turns about the housing. Naturally, a certain amount of routine experimentation may be employed to arrive at the proper formulation for any specific operation.

Thus, an improved mill is disclosed above. While embodiments and applications of this invention have been shown and described, it would be apparent to those skilled in the art that many more modifications are possible without departing from the inventive concepts herein described. The invention, therefore, is not to be restricted except as is necessary by the spirit of the appended claims.

What is claimed is:

1. A vibratory mill comprising:

a mill base;

a housing;

means for flexibly mounting said housing to said mill base;

means for inducing vibration in said housing;

a rigid foamed plastic support base positioned within said housing; and a rigid plastic liner cast within said support base, said liner and said support base forming a vertical wall spiralling outwardly and upwardly from a first end located centrally within said housing to the outer periphery of said housing and a floor which traverses the distance between succeeding turns of said vertical wall, said floor being inclined upwardly from said first end to the periphery of said housing, said vertical wall and said floor forming a chamber having substantially vertical sides and an inclined bottom and extending at least two and one-half turns within said housing and defining a central receiving chamber at said first end.

2. A vibratory mill comprising:

a mill base;

a housing;

means for flexibly mounting said housing to said mill base;

means for inducing vibration in said housing;

a rigid foamed plastic support base positioned within said housing; and a rigid plastic liner cast within said support base, said liner and said support base forming a vertical wall spiralling outwardly and upwardly from a first end located centrally within said housing to the outer periphery of said housing and a floor which traverses the distance between succeeding turns of said vertical wall, said floor being inclined upwardly from said first end to the periphery of said housing, said vertical wall and said floor forming a chamber having substantially vertical sides and an inclined bottom and extending more than one turn within said housing and defining a central receiving chamber at said first end.

* * * * *